US011105573B2

(12) United States Patent
Baert

(10) Patent No.: US 11,105,573 B2
(45) Date of Patent: Aug. 31, 2021

(54) DEVICE FOR DEFLECTING LINKS AND TURRET EQUIPPED WITH SUCH A DEFLECTOR DEVICE

(71) Applicant: NEXTER SYSTEMS, Roanne (FR)

(72) Inventor: Steve Baert, Bourges (FR)

(73) Assignee: NEXTER SYSTEMS, Roanne (FR)

( * ) Notice: Subject to any disclaimer, the term of this patent is extended or adjusted under 35 U.S.C. 154(b) by 0 days.

(21) Appl. No.: 16/960,619

(22) PCT Filed: Dec. 20, 2018

(86) PCT No.: PCT/EP2018/086126
§ 371 (c)(1),
(2) Date: Jul. 8, 2020

(87) PCT Pub. No.: WO2019/137781
PCT Pub. Date: Jul. 18, 2019

(65) Prior Publication Data

US 2020/0363149 A1 Nov. 19, 2020

(30) Foreign Application Priority Data

Jan. 9, 2018 (FR) ..... 1800018

(51) Int. Cl.
*F41A 9/37* (2006.01)
*F41A 9/60* (2006.01)
(Continued)

(52) U.S. Cl.
CPC *F41A 9/37* (2013.01); *F41A 9/60* (2013.01); *F41A 9/04* (2013.01); *F41A 9/54* (2013.01)

(58) Field of Classification Search
CPC ..... F41A 9/37; F41A 9/60
(Continued)

(56) References Cited

U.S. PATENT DOCUMENTS 2,323,430 A 7/1943 Trotter
2,803,169 A * 8/1957 Linke ..... F41A 9/27 89/33.25
(Continued)

FOREIGN PATENT DOCUMENTS

DE 33 08 676 A1 9/1984
EP 0 129 457 A1 12/1984
(Continued)

OTHER PUBLICATIONS

Sep. 12, 2018 Search Report issued in French Patent Application No. 1800018.
(Continued)

*Primary Examiner* — Bret Hayes
(74) *Attorney, Agent, or Firm* — Oliff PLC

(57) ABSTRACT

A device for deflecting links intended to equip a turret equipped with a weapon with a dual-feed for ammunition belts formed by links. This device is characterized in that it includes a deflector flap that is intended to be disposed between two orifices for ejecting links out of the turret, which flap is intended to be connected to the weapon by a fixing means including a ball joint connection disposed towards the front of the weapon, and a horizontal slide connection disposed towards the rear of the weapon. Also, a turret equipped with such a deflector.

4 Claims, 2 Drawing Sheets

(51) Int. Cl.
*F41A 9/04* (2006.01)
*F41A 9/54* (2006.01)

(58) Field of Classification Search
USPC ..... 89/33.04, 33.2
See application file for complete search history.

(56) References Cited

U.S. PATENT DOCUMENTS

| | | | |
|---|---|---|---|
| 4,562,768 | A | 1/1986 | Weinfurth et al. |
| 8,037,801 | B2 | 10/2011 | Coiffet et al. |

FOREIGN PATENT DOCUMENTS

| | | | | |
|---|---|---|---|---|
| EP | 2 107 329 | A1 | 10/2009 | |
| FR | 2 849 498 | A1 | 7/2004 | |
| WO | WO-2011050905 | A1 * | 5/2011 | ..... F41A 9/81 |

OTHER PUBLICATIONS

Sep. 12, 2018 Written Opinion issued in French Patent Application No. 1800018.
Mar. 13, 2019 International Search Report issued in International Patent Application No. PCT/EP2018/086126.
Mar. 13, 2019 Written Opinion of the International Searching Authority issued in International Patent Application No. PCT/EP2018/086126.

* cited by examiner

DEVICE FOR DEFLECTING LINKS AND TURRET EQUIPPED WITH SUCH A DEFLECTOR DEVICE

The technical field of the invention is that of turrets equipped with a weapon with a dual feed for ammunition belts formed by links and devices for deflecting links mounted on such turrets.

Weapons with a dual ammunition feed are known, for example from patent EP129457. They make it possible to fire two different types of ammunition, for example piercing ammunition and explosive ammunition.

The ammunition is brought to the weapon by corridors and connected to one another by belts made up of links.

During the insertion of an ammunition item into the chamber of the weapon, the link is ejected and it is expelled outside the turret. Most often, the link is steered and oriented by fixed sheet metal plates that cause it to fall toward a storage magazine. For example, patent EP2107329 may be considered, which discloses a device making it possible to separate the various links and which comprises deflectors orienting the separated links vertically toward the ground.

One problem encountered with dual-feed weapons is that the links leaving one of the ejection orifices are ejected toward the other ejection orifice. This results in a risk of clogging of one of the ejection orifices, leading to firing incidents.

Furthermore, the space separating the ejection orifices is most often limited, which complicates the placement of a fixed deflector.

It is the aim of the invention to propose a device for deflecting links that does not have such drawbacks.

The invention also relates to a turret equipped with a dual-feed weapon for ammunition equipped with such a device for deflecting links.

Thus, the device and the turret according to the invention make it possible to discharge the links coming from one or the other firing path without there being any accumulation or obstruction of one or the other path by the firing residue.

Thus, the invention relates to a device for deflecting links intended to equip a turret equipped with a weapon with a dual feed for ammunition belts formed by links, which device is characterized in that it comprises a deflector flap that is intended to be disposed between two orifices for ejecting links out of the turret, which flap is intended to be connected to the weapon by a fixing means comprising a ball joint connection disposed towards the front of the weapon, on the one hand, and a horizontal slide connection disposed towards the rear of the weapon, on the other hand, the flap thus being able to be pushed towards one orifice by the links leaving through the other orifice.

According to one specific embodiment, the device is characterized in that the flap is secured to a support intended to allow it to be fixed to the turret, which support comprises two strips connected by spacers, the flap extending between the two strips and being articulated relative to the two strips, the flap being connected to a first strip by the ball joint connection and being connected to the second strip by the slide connection.

The slide connection may have a travel of at least 20 mm on either side of a median position.

The invention also relates to a turret equipped with a weapon with a dual feed of ammunition belts formed by links, which turret comprises a first and a second orifice for ejecting links disposed in its rear part and substantially across from one another, which turret comprises at least one flap deflecting links disposed in the vicinity of one of the orifices for ejecting links, which turret is characterized in that it comprises a device for deflecting links according to the invention.

The invention will be better understood upon reading the following description, the description being done in reference to the appended drawings and in which.

Figure 4A:
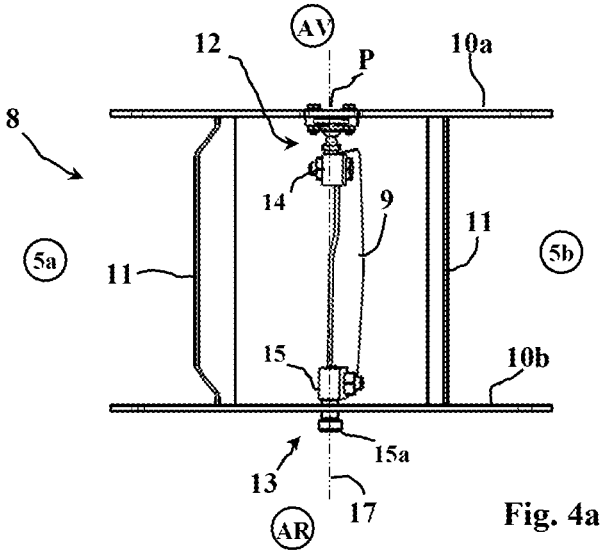
Figure 4B:
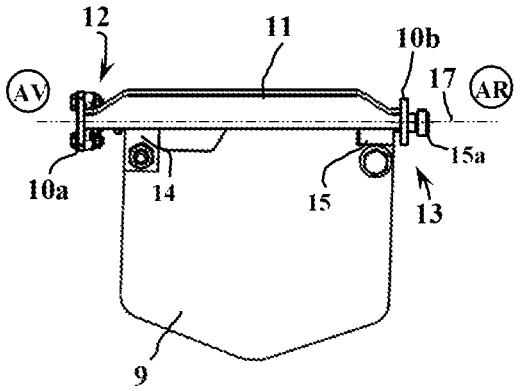
Figure 4C:
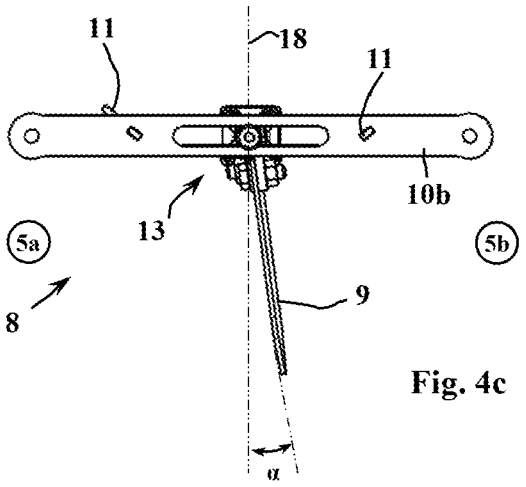
Figure 5:
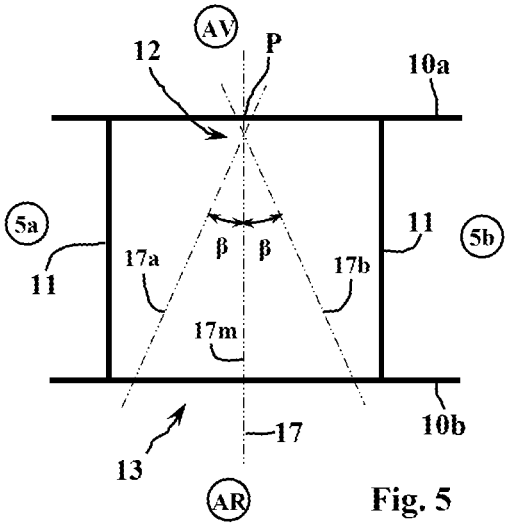

FIGS. 4*a*, 4*b* and 4*c* are three views of this deflector, FIG. 4*a* being a top view, FIG. 4*b* a side view and FIG. 4*c* a rear front view;

FIG. 5 is a schematic top view of the deflector showing the extreme positions of the flap.

Figure 1:
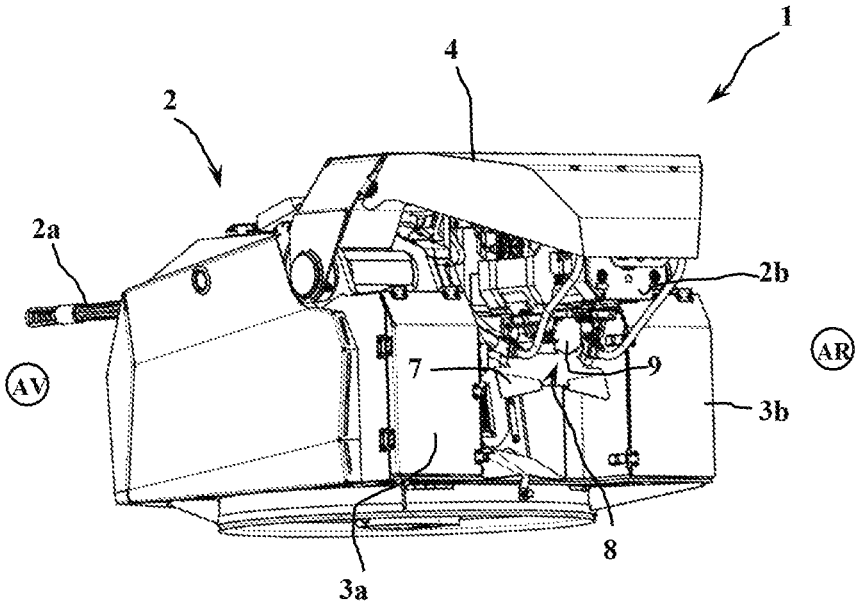
FIG. 1 is a rear perspective view of a turret according to the invention, this view making it possible to locate the deflector device according to the invention.
Figure 2:
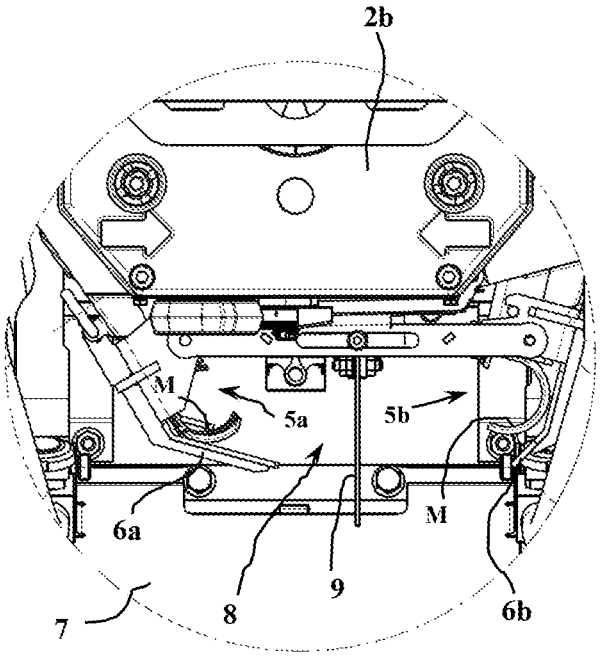
FIG. 2 is a partial and enlarged view of the turret showing the deflector according to the invention.

In reference to FIGS. 1 and 2, a turret 1 according to the invention comprises a weapon 2, the figure showing the tube 2*a* and the rear breech casing 2*b*. This weapon is a tubular weapon with a dual ammunition feed. Such a weapon is disclosed by patent EP129457. The ammunition is in belts and is brought from two magazines 3*a* and 3*b* via corridors, not visible in the figures, and that are connected to the weapon below the rear cover 4.

FIG. 2 more precisely shows the rear of the breech casing 2*b*, which bears the two ejection orifices of the links 5*a* and 5*b*. This FIG. 2 shows links M leaving the weapon.

The turret 1 includes metal guide sheets 6*a* and 6*b* that are arranged below each orifice 5*a* and 5*b* and that guide the links in a direction inclined toward the ground.

Furthermore, a lower metal sheet 7 (FIG. 1) forms an apron that orients the links M toward the rear of the turret 1.

The turret 1 includes a device 8 for deflecting links according to the invention, which device comprises a deflector flap 9 that is intended to be disposed between the two ejection orifices 5*a* and 5*b*.

As shown more specifically in FIG. 3 and FIGS. 4*a*, 4*b* and 4*c*, the flap 9 is secured to a support 10 that is intended to allow it to be fixed to the turret 1 by conventional means that are not shown, such as screws and nuts. The support 10 thus comprises two strips 10*a* and 10*b* that are connected by spacers 11.

Figure 3:
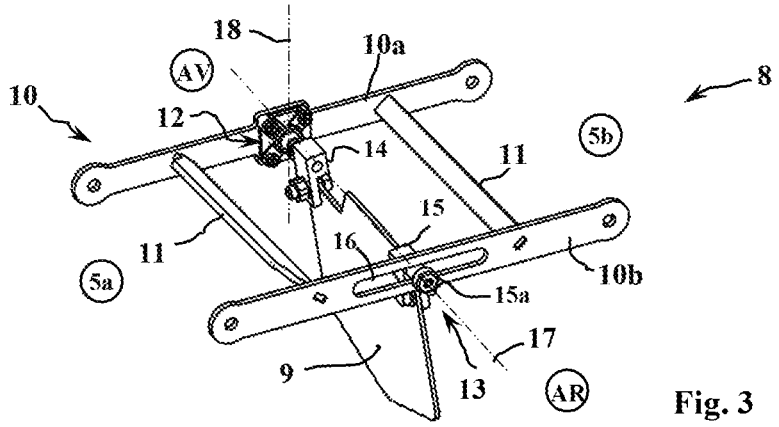
FIG. 3 is a perspective view of one embodiment of the deflector according to the invention, the deflector being shown isolated from the turret.

FIGS. 3 to 5 identify the ejection orifices 5*a* and 5*b* as well as the front AV and the rear AR of the weapon.

The flap 9 therefore extends between the two strips 10*a* and 10*b* and it is articulated relative to the two strips. More specifically, the flap 9 is connected to the first strip 10*a* (that disposed toward the front AV of the weapon) by a ball joint connection 12, and it is connected to the second strip 10*b* (that disposed toward the rear AR of the weapon) by a slide connection 13.

From a structural perspective, the flap 9 bears two clamps 14 and 15 that are fixed to each upper end of the flap 9. A front clamp 14 bears a rod with a spherical end (not shown) that is engaged in a complementary seat fixed to the first strip 10*a*. The rod and seat form the ball joint 12. A rear clamp 15 bears a rod 15*a* that circulates in a horizontal groove 16 arranged in the second strip 10*b*. The rod 15*a* and the groove 16 form the slide connection 13.

The ball joint 12 thus forms a fixed fastening point P of the flap on the first strip, which fastening point is disposed toward the front AV of the weapon and in the vicinity of which the flap 9 can a priori pivot in all directions.

The pivoting capability of the flap 9 is limited by the slide connection 13, which only allows a translation of the rod 15*a* in the groove 16 and a pivoting of the flap 9 about its axis 17, which is the straight line connecting the point P to the rod 15*a*. The axis 17 practically follows the upper edge of the flap 9. The axis 17 can therefore pivot in a limited manner about an axis 18 perpendicular to the axis 17. The axis 18 is substantially vertical and passes through the sphere of the ball joint 12.

FIG. 5 schematically shows the possible extreme positions 17*a* and 17*b* for the axis 17 of the flap 9. In these positions, the axis 17 of the flap forms an angle β relative to its median position 17*m*.

The groove 16 has a length of substantially 40 mm, which allows a movement of the rod 15*a* of at least 20 mm on either side of a median position 17*m* of the axis 17.

Furthermore, in each position of the flap 9, the latter can also pivot about its axis 17 and adopt an incline by angle α (FIG. 4*c*).

Owing to the invention, when a link M is ejected through one of the ejection orifices, it pushes the flap 9, which then approaches the other ejection orifice.

One thus avoids the clogging of one orifice by the links ejected from the other orifice.

The flap remains free to pivot about its axis 17 and adopts, during the impact from the links, an orientation that is favorable to a deflection of the links, both towards the rear of the turret 1 (owing to the angle β) and towards the bottom (owing to the angle α), towards the lower metal sheet 7.

When another feed path of the weapon is used, the links are ejected via the other ejection orifice and the flap 9 assumes a position symmetrical to the previous one.

In all cases, the flap adopts the position most favorable to the ejection of the links from one or the other path, while preventing the closing off of the opposite path, and in a minimal bulk.

As a variant, it is possible to secure the flap 9 to a ball joint and a slide that are directly connected to the weapon, without defining a specific support.

The invention claimed is:

1. A device configured to deflect links of a turret that is equipped with a weapon and that has a dual feed for ammunition belts formed by the links, the device comprising:

a deflector flap that is configured to be disposed between two orifices for ejecting the links out of the turret, the flap being configured to be connected to the weapon by a ball joint connection disposed towards a front of the weapon, and a horizontal slide connection configured to be disposed towards a rear of the weapon, the flap being configured to be pushed towards a first orifice of the two orifices by the links leaving through a second orifice of the two orifices.

2. The device according to claim 1, wherein:

the flap is secured to a support configured to fix the flap to the turret, the support comprises two strips connected by spacers, the flap extends between the two strips and is articulated relative to the two strips, and the flap is connected to a first strip of the two strips by the ball joint connection and is connected to the second strip of the two strips by the slide connection.

3. The device according to claim 1, wherein the slide connection can travel at least 20 mm on either side of a median position.

4. The turret that is equipped with the weapon and that has the dual feed for ammunition belts formed by the links, the turret comprising:

the device according to claim 1, and the first orifice and the second orifice for ejecting the links, the first orifice and the second orifice being disposed in a rear part of the turret and substantially across from one another, wherein the flap deflecting the links is disposed in a vicinity of one of the first orifice and the second orifice for ejecting the links.

* * * * *